US007794368B2

(12) United States Patent
Rutherford

(10) Patent No.: US 7,794,368 B2
(45) Date of Patent: Sep. 14, 2010

(54) SHOE ASSEMBLY FOR STRENGTH TRAINING AND FITNESS EXERCISE

(76) Inventor: Ralph A. Rutherford, 18536 Rellant Dr., Gaithersburg, MD (US) 20879

( * ) Notice: Subject to any disclaimer, the term of this patent is extended or adjusted under 35 U.S.C. 154(b) by 94 days.

(21) Appl. No.: 11/928,807

(22) Filed: Oct. 30, 2007

(65) Prior Publication Data

US 2009/0107010 A1 Apr. 30, 2009

(51) Int. Cl.
*A63B 23/08* (2006.01)

(52) U.S. Cl. ..... 482/79; 482/129

(58) Field of Classification Search ..... 482/79, 482/124; 36/43–44, 113–135
See application file for complete search history.

(56) References Cited

U.S. PATENT DOCUMENTS

| | | | | | |
|---|---|---|---|---|---|
| 771,938 | A | * | 10/1904 | Ruhl | 482/79 |
| 2,114,790 | A | * | 4/1938 | Venables | 482/105 |
| 2,522,515 | A | * | 9/1950 | Hill | 36/104 |
| 2,760,774 | A | * | 8/1956 | Perez | 482/79 |
| 2,835,249 | A | * | 5/1958 | Brandano | 128/882 |
| 3,343,836 | A | * | 9/1967 | Forrest, Jr. | 482/105 |
| 3,477,426 | A | * | 11/1969 | Wincheski | 602/29 |
| 3,487,829 | A | * | 1/1970 | Barnett | 602/24 |
| 3,785,646 | A | * | 1/1974 | Ruskin | 482/105 |
| 4,222,182 | A | | 9/1980 | Sears | |
| 4,334,367 | A | * | 6/1982 | Salomon | 36/117.2 |
| 4,573,457 | A | * | 3/1986 | Parks | 602/29 |
| 4,596,387 | A | * | 6/1986 | Roberts | 482/139 |
| 4,709,921 | A | * | 12/1987 | Valuikas et al. | 482/105 |
| 4,728,103 | A | * | 3/1988 | Fulton | 482/125 |
| 4,756,095 | A | * | 7/1988 | Lakic | 36/2.6 |
| 4,930,233 | A | * | 6/1990 | Provence | 36/117.2 |
| 4,948,117 | A | * | 8/1990 | Burke | 482/55 |
| 5,094,231 | A | * | 3/1992 | Rosen | 602/24 |
| 5,186,701 | A | * | 2/1993 | Wilkinson | 482/125 |
| 5,241,762 | A | | 9/1993 | Rosen | |
| 5,263,916 | A | * | 11/1993 | Bobich | 482/124 |
| 5,267,930 | A | * | 12/1993 | Henes | 482/139 |
| 5,372,565 | A | * | 12/1994 | Burdenko | 482/124 |
| 5,490,823 | A | | 2/1996 | Awbrey et al. | |
| 5,545,113 | A | * | 8/1996 | Bobich | 482/125 |
| 5,613,926 | A | * | 3/1997 | Michaelson | 482/121 |
| 5,624,360 | A | * | 4/1997 | Wilkins | 482/129 |
| 5,713,142 | A | * | 2/1998 | Ahmed Fahmey El-Circy | 36/132 |
| 5,782,727 | A | * | 7/1998 | Pierce | 482/129 |
| 5,926,975 | A | * | 7/1999 | Goodman et al. | 36/31 |
| 6,023,859 | A | * | 2/2000 | Burke et al. | 36/105 |
| 6,065,769 | A | * | 5/2000 | Simonetti et al. | 280/615 |
| 6,105,283 | A | | 8/2000 | Park et al. | |
| 6,151,803 | A | * | 11/2000 | Charles | 36/72 R |
| 6,436,012 | B1 | * | 8/2002 | Naville | 482/77 |
| 6,601,321 | B1 | * | 8/2003 | Kendall | 36/88 |
| 6,634,993 | B1 | * | 10/2003 | Morr | 482/55 |
| 6,875,135 | B2 | * | 4/2005 | Tracy, Sr. | 473/438 |
| 7,044,896 | B2 | | 5/2006 | Hetrick | |

(Continued)

*Primary Examiner*—Fenn C Mathew
*Assistant Examiner*—Andrew M Tecco
(74) *Attorney, Agent, or Firm*—Blank Rome LLP

(57) ABSTRACT

Insole constructions for shoes including articulated components that allow for the connection of attachments having various devices are described. The insole constructions provide a supported attachment point for various components while not compromising the flexibility of the shoe. The insole constructions allow for attachment of devices at the heel, toe or sides of the shoe. Devices for attaching to shoes having the insole construction are also described, along with apparatuses for use with shoes having the insole construction.

29 Claims, 14 Drawing Sheets

U.S. PATENT DOCUMENTS

| | | | | |
|---|---|---|---|---|
| 7,082,700 | B2 * | 8/2006 | Meschan | 36/42 |
| 7,087,003 | B1 * | 8/2006 | Katterjohn | 482/124 |
| 7,337,562 | B2 * | 3/2008 | Kim | 36/132 |
| 2004/0204302 | A1 * | 10/2004 | Flynn | 482/124 |
| 2005/0039350 | A1 * | 2/2005 | Hung | 36/107 |
| 2006/0183609 | A1 * | 8/2006 | Flynn | 482/124 |
| 2007/0060454 | A1 * | 3/2007 | Vogel | 482/121 |
| 2007/0107264 | A1 * | 5/2007 | Meschter et al. | 36/76 R |

* cited by examiner

SHOE ASSEMBLY FOR STRENGTH TRAINING AND FITNESS EXERCISE

FIELD OF THE INVENTION

The present invention relates to shoes which allow for the attachment of components to the shoe as well as the components themselves. More specifically, the present invention relates to a shoe having an insole construction that allows for the attachment of components to the shoe which facilitates the wearer of the shoe in performing strength training and fitness exercise.

BACKGROUND OF THE INVENTION

Most modern fitness proponents recommend a balanced and diverse exercise program for obtaining optimal fitness and wellness. Recommended exercise programs typically include elements of cardiovascular exercise, strength training and stretching to achieve better fitness, health, and weight management. Because of this, many active people participate in cross-training type exercise programs, performing many different types of exercises. Furthermore, many active or inactive people might not be able to withstand large amounts of joint pressure created by the use of conventional exercise equipment.

Popular methods of strength training include the use of elastic resistance bands and weight machines with cables attached to stacks of weights. In the use of both resistance bands and cable machines, upper body exercises are typically easily performed as the exerciser is able to grasp the resistance bands and cables with their hands. However, to effectively perform lower body strength training by these methods, the bands or cables need to be fastened somehow to the shoes of the exerciser. This may be done using loops or harnesses that fit over the shoe. However, loops and harnesses are prone to slip, which can be very dangerous during the performance of an exercise, and further require extra manipulations and equipment for attaching strength training equipment to the shoe.

U.S. Pat. No. 5,713,142 to El-Circy describes a training shoe allowing for the attachment of elastic bands directly to the shoe. However, El-Circy describes a shoe with attachment points that are preferably connected to one another with a rigid member that inhibits flexing of the shoe, or with attachment points that are secured only in the foam of the shoe midsole without any support. In the first case, the flexibility of the shoe is compromised, greatly limiting its use. In the second case, the attachment points are unsupported and are too weak to support the attachment of resistance strong enough to promote effective strength training.

As such, there remains a need in the art for the safe, simple, and effective attachment of exercise components to a shoe without compromising the performance of the shoe. In this way, the shoe can be used for a variety of exercises, saving the wearer time and money without compromising the quality of his or her exercise program.

SUMMARY OF THE INVENTION

It is an object of the present invention to provide a shoe with an articulated insole construction having a connector for receiving an attachment that can be used for performing fitness exercise.

It is a further object of the present invention to provide a shoe with an articulated insole construction having a plurality of hinged plates running from the toe to the heel of the shoe and an end plate having a connector for receiving an attachment. The hinged plates and end plate are hinged to one another in a manner that allows for the free rotation of the plates around an axis transverse to the shoe, allowing a shoe containing the articulated insole construction to maintain its flexibility.

It is a still further object of the present invention to provide a variety of attachments having an exercise device for attaching to a shoe of the present invention. The exercise devices of such attachments include, but are not limited to, handles, eyelets, reflectors, hooks, D-rings, loops and the like.

It is a still further object of the present invention to provide a shoe having an articulated insole construction having a plurality of hinged plates extending from the toe to the heel of the shoe, wherein at least one of the hinged plates has a connector for receiving an attachment.

It is a still further object of the present invention to provide an apparatus for performing leg strengthening exercises using elastic bands attached to an exercise device on a shoe. The apparatus allows the exerciser to attach an elastic band to a base and to the shoe, providing resistance for strength training exercises.

It is yet a further object of the present invention to provide an apparatus for performing weight resistance exercises that attaches to a shoe having an exercise device. The apparatus allows the user to attach the exercise device of the shoe to a mechanism operatively linked with weight resistance, providing resistance for strength training exercises.

DESCRIPTION OF THE DRAWINGS

Embodiments of the invention will be set forth in detail with reference to the drawings, in which.

DETAILED DESCRIPTION OF THE INVENTION

Figure 1:
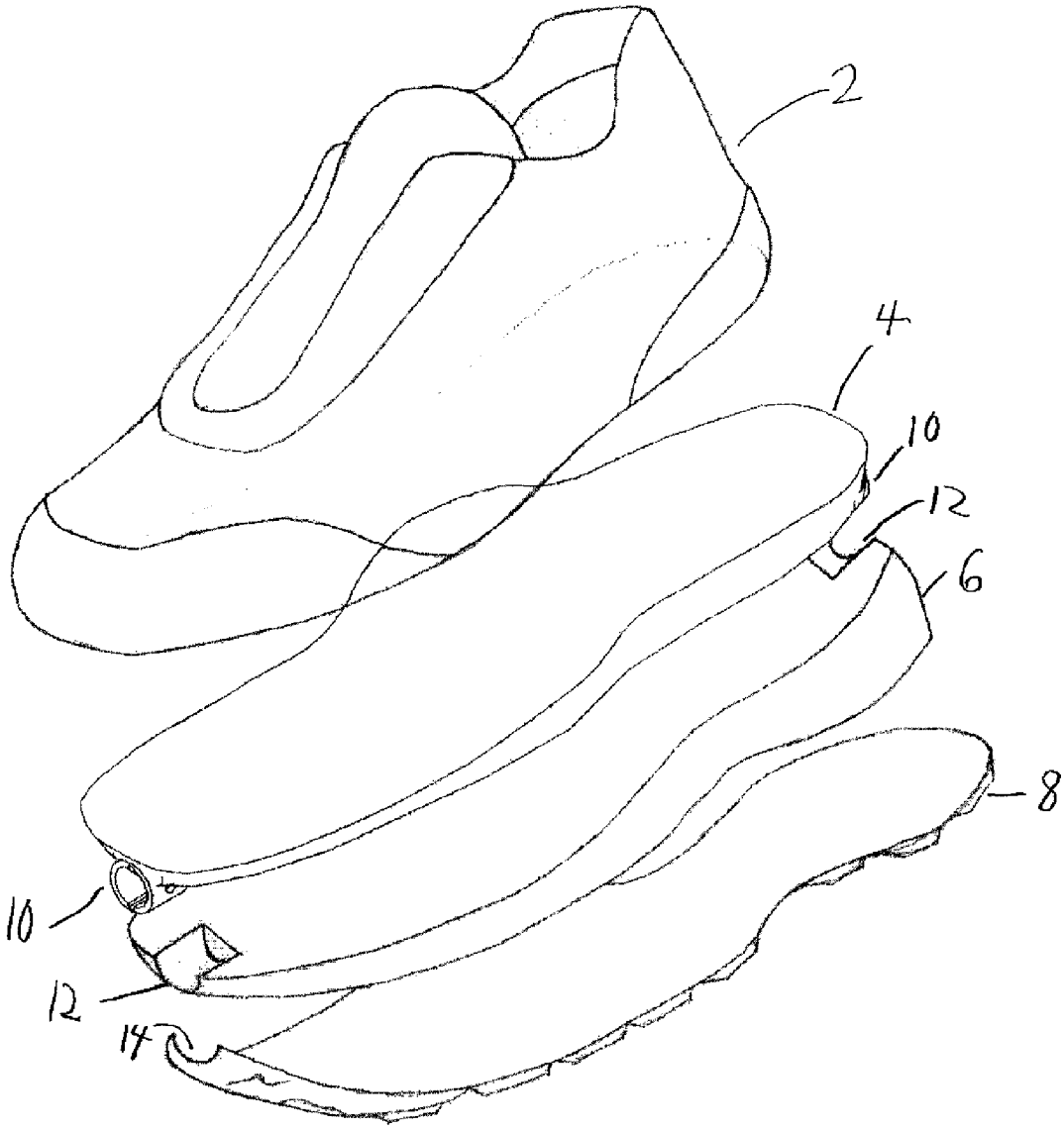
FIG. 1 is an exploded perspective view of a shoe containing an articulated insole construction with connectors at the heel and toe of the shoe.

The present invention is a shoe that allows for the attachment of exercise devices to the shoe as well as the devices. The shoe of the invention has an articulated insole construction that allows for secure attachment of devices while still maintaining the flexibility of the shoe.

The shoe of the present invention preferably functions in the same manner as a standard shoe for the specific purpose chosen, while also allowing for the attachment of attachment pieces having different functionalities. The present invention may be embodied in various types of athletic shoes, including shoes for walking, running, hiking, cross-training, tennis, court sports and outdoor sports where outsoles requiring special traction, such as cleats or spikes, may be necessary. The present invention may also be embodied in other types of shoes, such as shoes and boots for work or casual wear. The insole constructions of the present invention are designed to allow for the attachment of devices to the shoe without detracting from the original use of the shoe, e.g. a running shoe containing an insole construction of the present invention is still functional as a running shoe. Attachments are typically attached to the shoe at least securely enough to support at least the body weight of the wearer of the shoe without becoming detached, but may also be attached securely enough to support much more weight and force upon the attachment.

Certain embodiments of the invention are described in the drawings. In each of the drawings, like components are labeled with like reference numerals. However, it should be understood that there are other embodiments which are not explicitly shown in the drawings which fall within the scope and spirit of the claims set forth below.

Turning to FIG. 1, an exploded perspective view of an embodiment of the shoe of the present invention having connectors at the heel and toe is shown. The shoe embodied in FIG. 1 has an upper 2, which may be made of synthetic material, leather, cloth or any material typically used in the construction of shoe uppers. Beneath the upper 2 is the insole 4. Typically, the articulated insole construction of the present invention will be present inside the insole 4, as will be described. In the view of FIG. 1, only the connectors 10 of the insole construction are visible. The insole 4 may be made of any material suitable for constructing shoe insoles, including polymeric foam materials and gel materials. Below the insole 4 is the midsole 6, which may be made of any material suitable for constructing shoe midsoles, such as polymeric foam materials. The midsole 6 may have midsole recesses 12 for receiving the connectors 10 of the insole construction. Below the midsole 6 is the outsole 8, which may be made of any material suitable for constructing shoe outsoles, such as rubber. The outsole may have one or more outsole recesses 14, for receiving the connectors 10 of the insole construction.

The different layers shown in FIG. 1 may be assembled together to form a shoe using any suitable method for such assembly. For example, the different layers may be assembled with an adhesive, or by stitching layers together.

Figure 2:
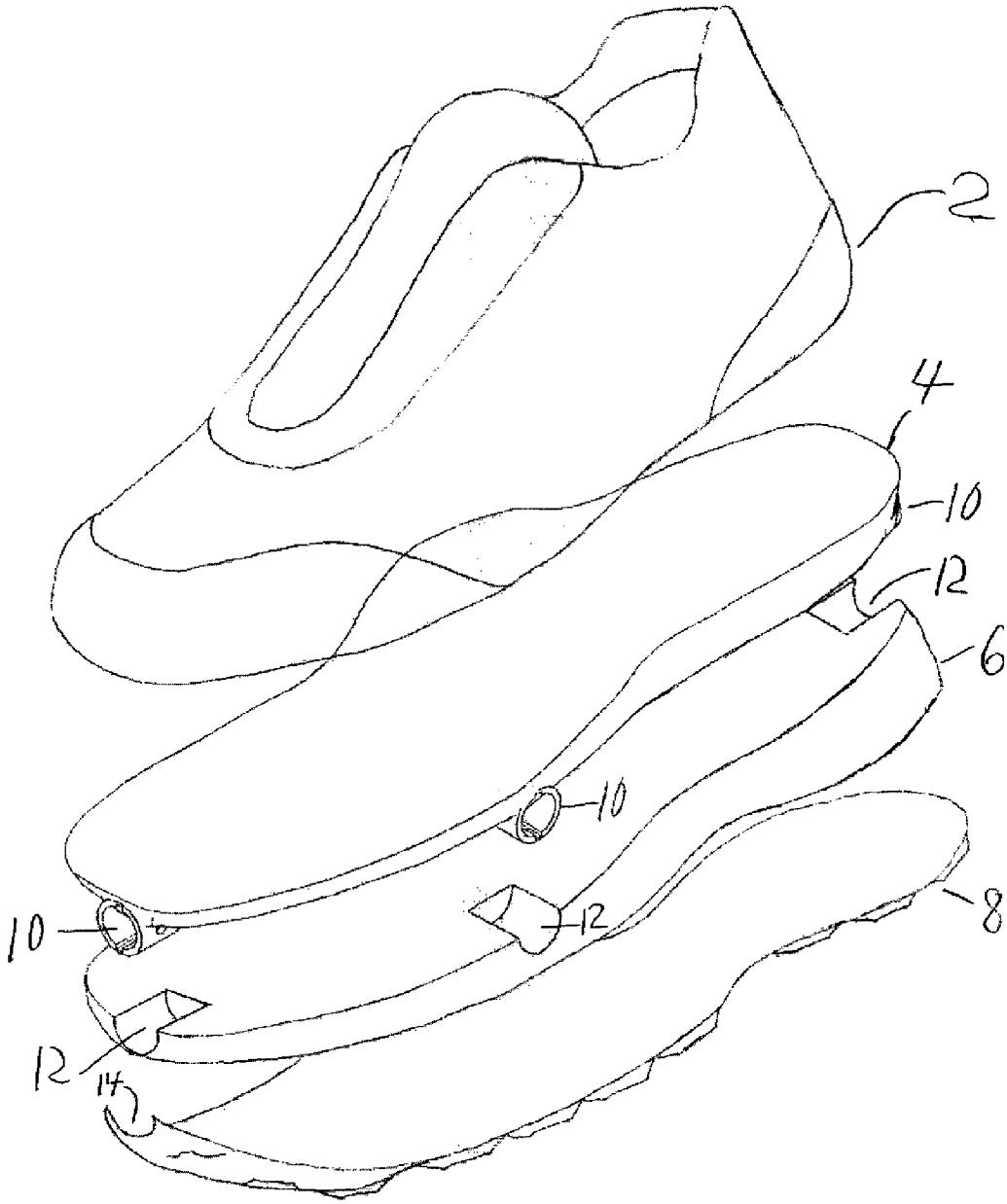
FIG. 2 is an exploded perspective view of a shoe containing an articulated insole construction with connectors at the heel, toe and side of the shoe.

Turning to FIG. 2, an exploded perspective view of an embodiment of the shoe of the present invention having connectors at the heel, toe and side is shown. The embodiment of FIG. 2 may be constructed as described for the embodiment of FIG. 1, using an articulated insole construction having one or more connectors located on its sides, as will be described below.

Figure 3:
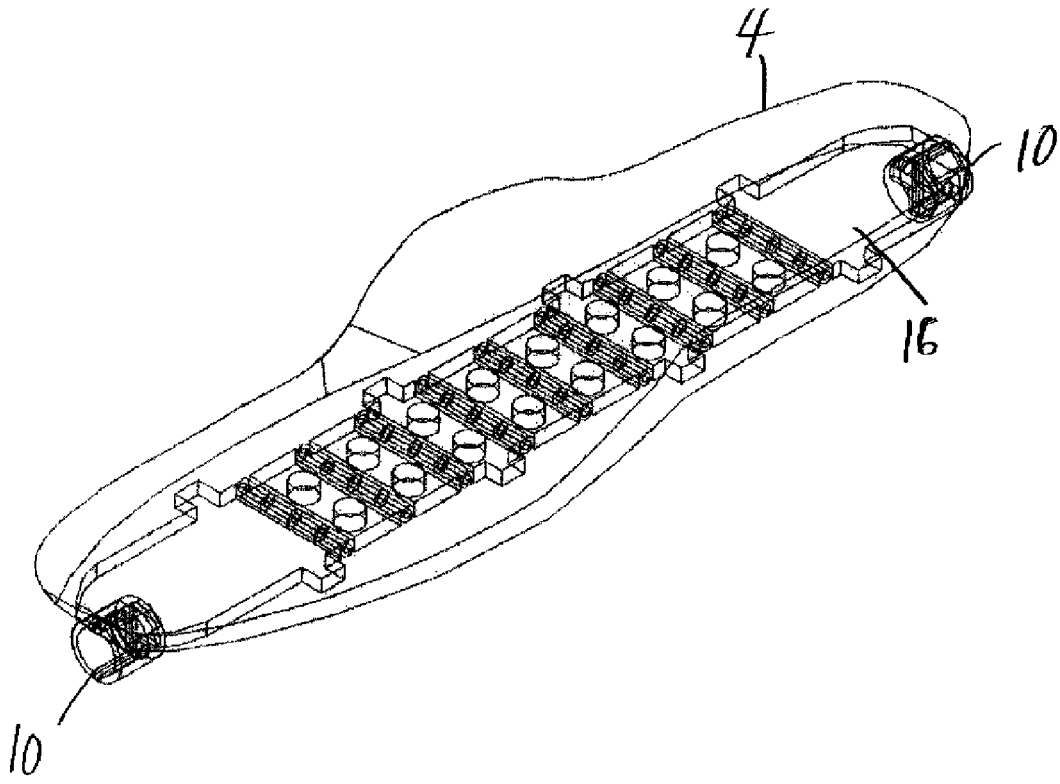
FIG. 3 is a perspective view of a shoe insole containing an articulated insole construction with connectors at the heel and toe of the shoe.

Regarding FIG. 3, a perspective view of an embodiment of an insole 4 having an articulated insole construction 16 with connectors 10 at the heel and toe of the shoe is shown. Regarding FIG. 4, a perspective view of an embodiment of an insole 4 having an articulated insole construction 16 with connectors 10 at the heel, toe and sides of the shoe is shown. In certain embodiments of the present invention, the insole 4 is formed around the articulated insole construction 16 during the construction of the insole 4. For example, if the insole 4 is formed from a liquid polymeric material, the articulated insole construction 16 may already be present inside of the insole cast before the liquid polymeric material is added. In other embodiments of the present invention, the formed insole 4 may be cut or otherwise opened to allow the insole construction 16 to be added, after which the insole 4 may be resealed. In the embodiment shown in FIG. 3, the insole construction 16 has connectors 10 at both the heel and toe of the shoe. In the embodiment shown in FIG. 4, the insole construction 16 has connectors 10 at the heel, toe and both sides of the shoe. However, it is also contemplated that embodiments of the present invention may have only one or more than two connectors. Furthermore, it is contemplated that embodiments of the present invention may have connectors located in various locations along the shoe. This includes shoes without a connector at either or both the toe and heel and shoes with no, one or multiple connectors on each side.

FIGS. 5A-5D show various views of an embodiment of an end plate 18 of the present invention. The embodiment of FIG. 5 has a connector 10 having at least one mating groove 32 and at least one receiving hole 34, for receiving attachments as will be described. As shown in FIG. 5, the end plate 18 may have one or more flanges 19, which are embedded within the insole 4. In the embodiment of FIG. 5, the end plate 18 has two interconnecting members 42 which have pin holes 25 for receiving a pin 24 as described in FIG. 9.

Figure 4:
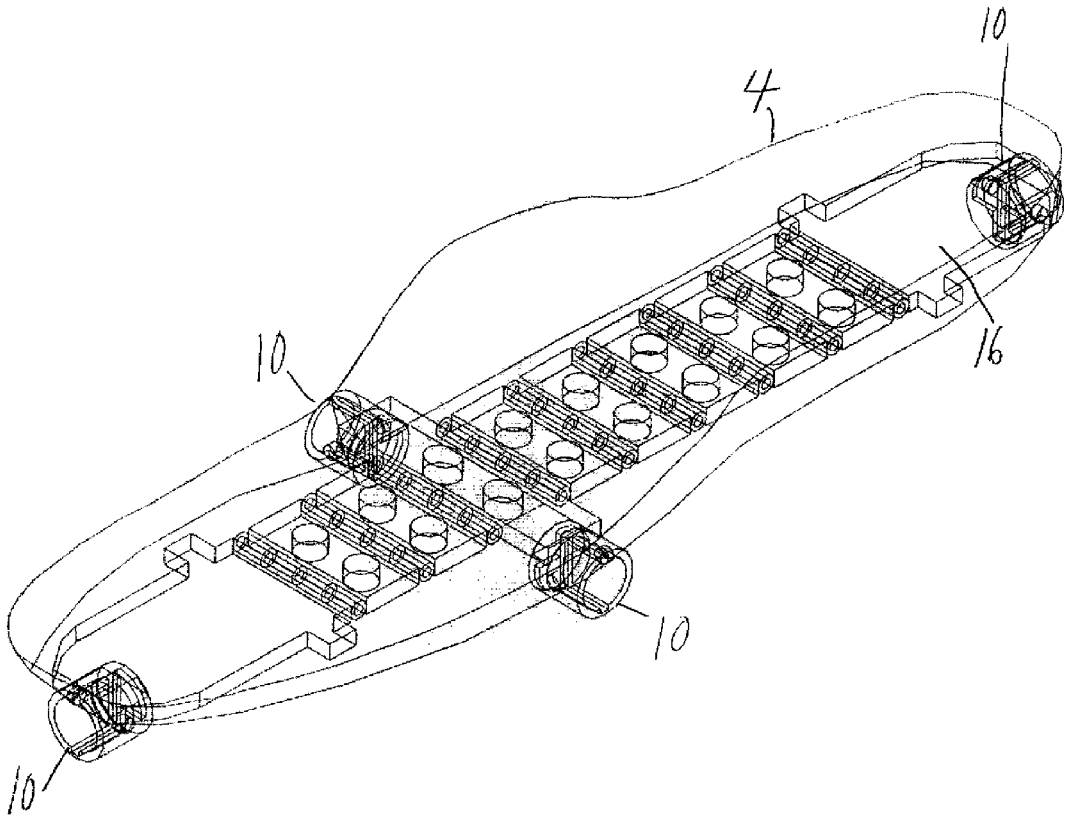
FIG. 4 is a perspective view of a shoe insole containing an articulated insole construction with connectors at the heel, toe, and sides of the shoe.
Figure 5B:
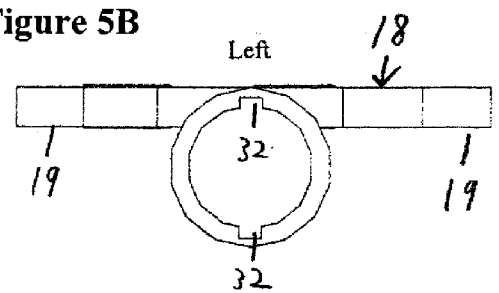
FIG. 5B is a left view of an end plate for an articulated insole construction.
Figure 5D:
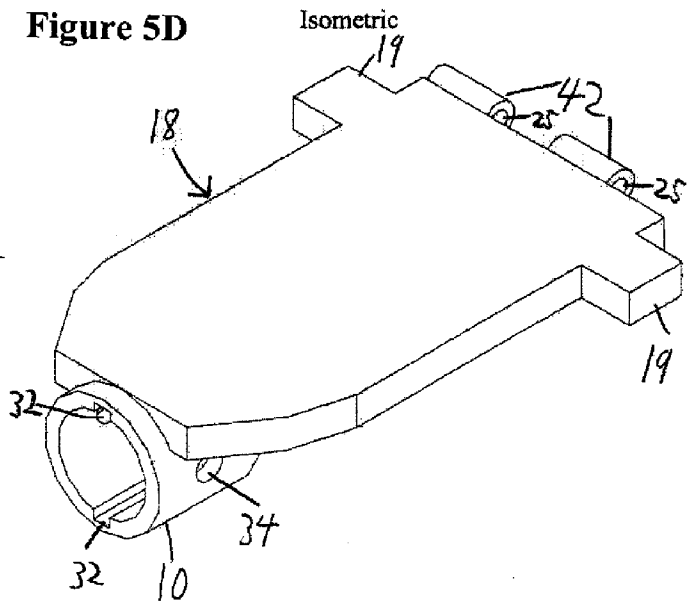
FIG. 5D is a perspective view of an end plate for an articulated insole construction.
Figure 5A:
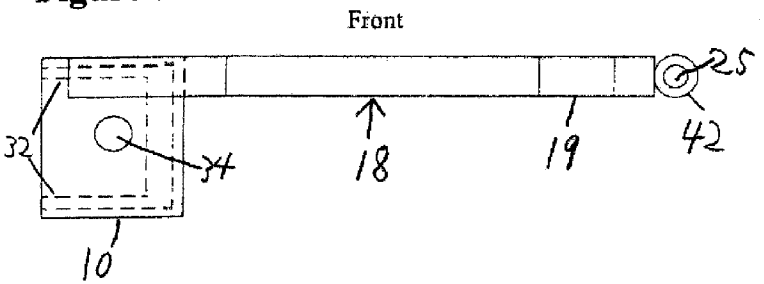
FIG. 5A is a front view of an end plate for an articulated insole construction.
Figure 5C:
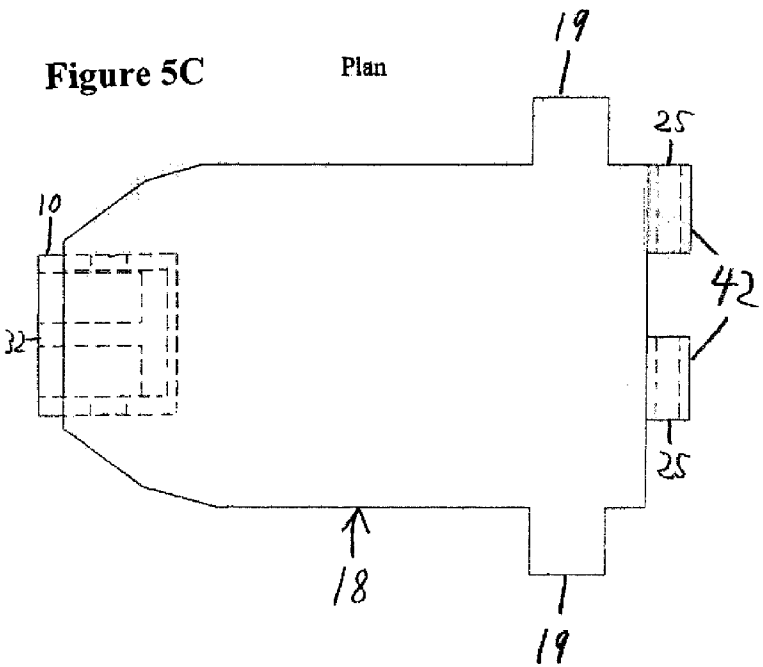
FIG. 5C is a plan view of an end plate for an articulated insole construction.
Figure 6B:
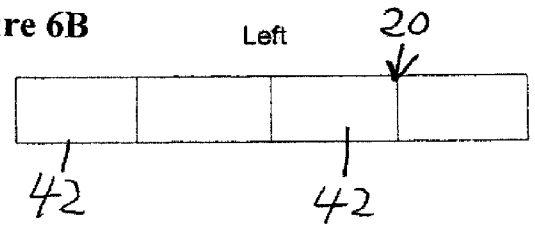
FIG. 6B is a left view of a hinged plate for an articulated insole construction.
Figure 6D:
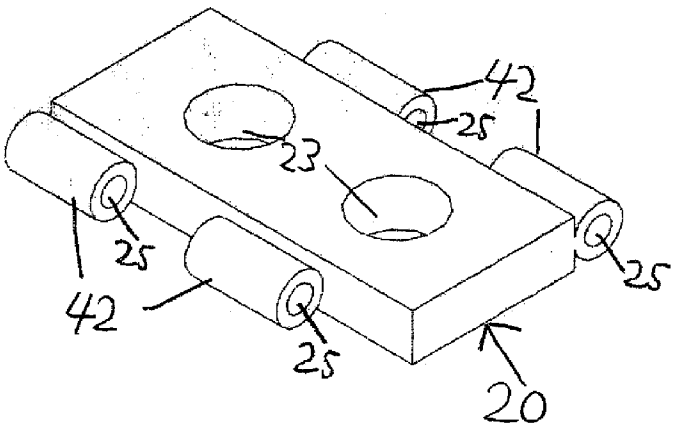
FIG. 6D is a perspective view of a hinged plate for an articulated insole construction.
Figure 6A:
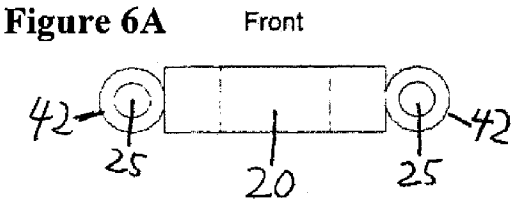
FIG. 6A is a front view of a hinged plate for an articulated insole construction.
Figure 6C:
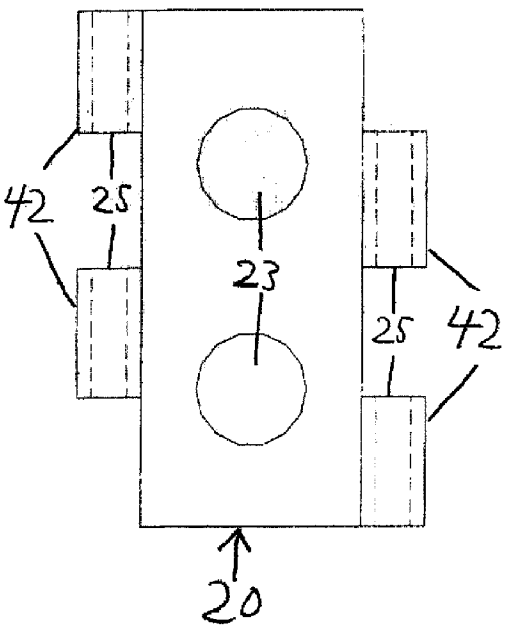
FIG. 6C is a plan view of a hinged plate for an articulated insole construction.
Figure 7A:
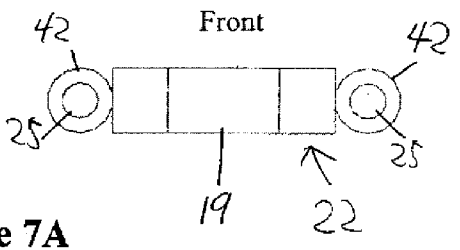
FIG. 7A is a front view of a hinged plate for an articulated insole construction having flanges that embed in the insole of the shoe.
Figure 7B:
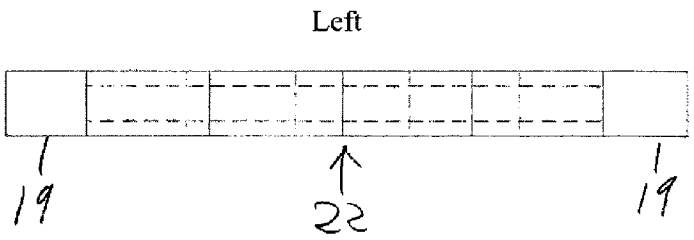
FIG. 7B is a left view of a hinged plate for an articulated insole construction having flanges that embed in the insole of the shoe.
Figure 7C:
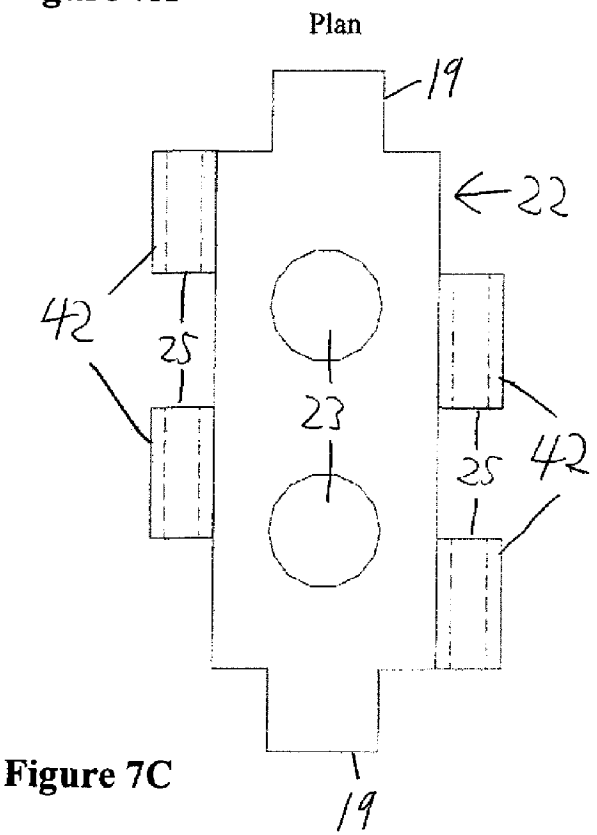
FIG. 7C is a plan view of a hinged plate for an articulated insole construction having flanges that embed in the insole of the shoe.
Figure 7D:
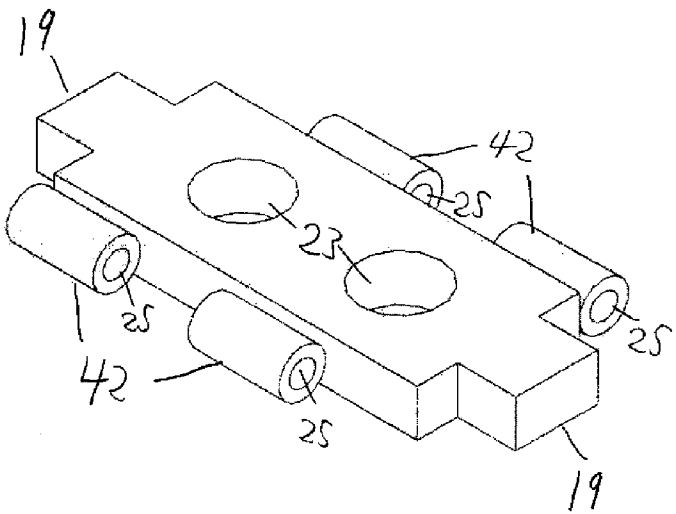
FIG. 7D is a perspective view of a hinged plate for an articulated insole construction having flanges that embed in the insole of the shoe.
Figure 8B:
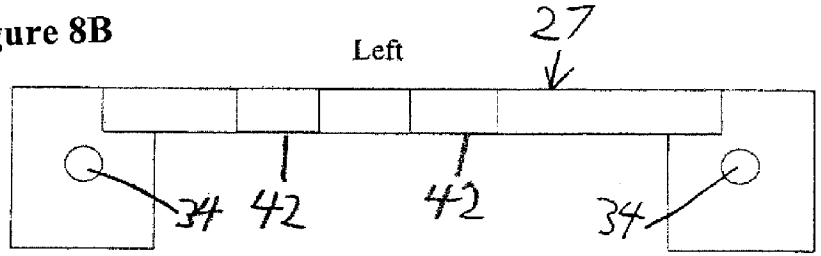
FIG. 8B is a left view of a hinged plate for an articulated insole construction having a connector on each end.
Figure 8D:
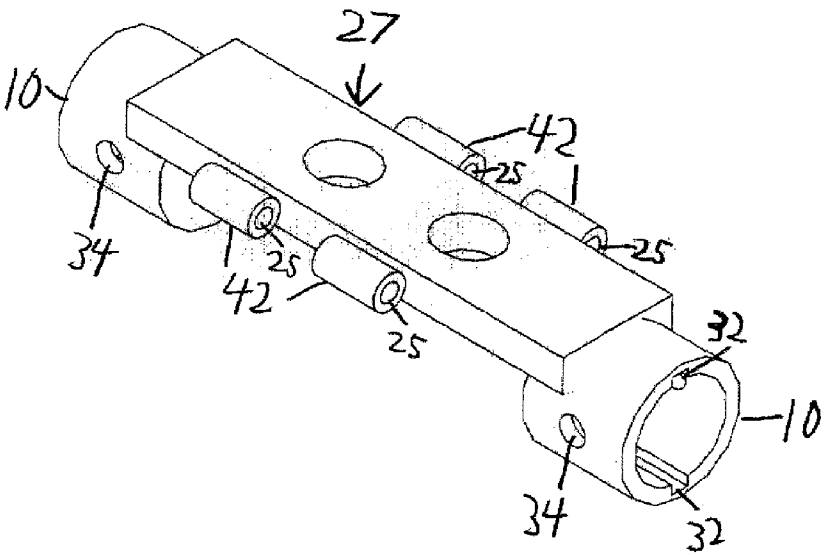
FIG. 8D is a perspective view of a hinged plate for an articulated insole construction having a connector on each end.
Figure 8A:
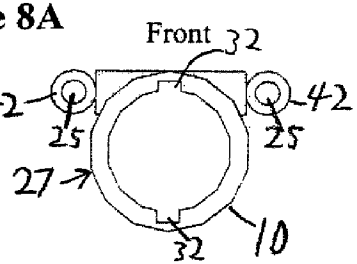
FIG. 8A is a front view of a hinged plate for an articulated insole construction having a connector on each end.
Figure 8C:
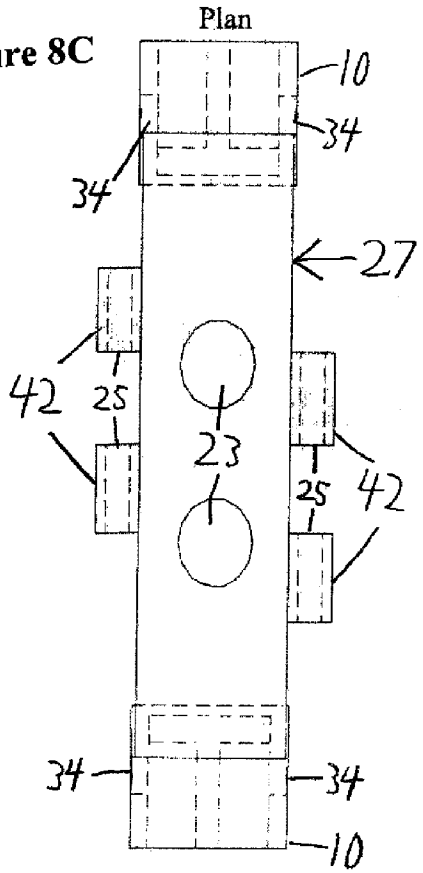
FIG. 8C is a plan view of a hinged plate for an articulated insole construction having a connector on each end.

FIGS. 6A-6D show various views of an embodiment of a hinged plate 20 of the present invention. The hinged plate 20 may have one or more holes 23, which allow air to pass through the articulated insole construction, maintaining the breathability of the shoe. The holes 23 help to reduce the weight of the hinged plate 20 and hence the overall weight of the insole construction 16. Further, when the articulated insole structure 16 is present at the time of casting the insole 4 from liquid material, the liquid material fills the holes 23 and solidifies, causing the articulated insole construction 16 to be more securely held within the insole 4. In the embodiment of FIG. 4, the hinged plate 20 has four interconnecting members 42, two on each side, which have pin holes 25 for receiving a pin 24 as shown in FIG. 9.

FIGS. 7A-7D show various views of an embodiment of a hinged plate 22 of the present invention with flanges. The hinged plate 22 shown in FIG. 7 is similar to the hinged plate 20 just described, the only difference being the presence of one or more flanges 19, which embed in the insole.

FIGS. 8A-8D show various views of an embodiment of a hinged plate 27 of the present invention with connectors 10 on each side. The hinged plate 27 shown in FIG. 8 is similar to the hinged plate 20 just described, the only difference being the presence of one or more connectors 10, which allow for the connection of attachments along the side of the shoe. The connectors 10 on the hinged plate 27 are analogous to the connector 10 on the end plate 18 described in FIG. 5.

Figure 9:
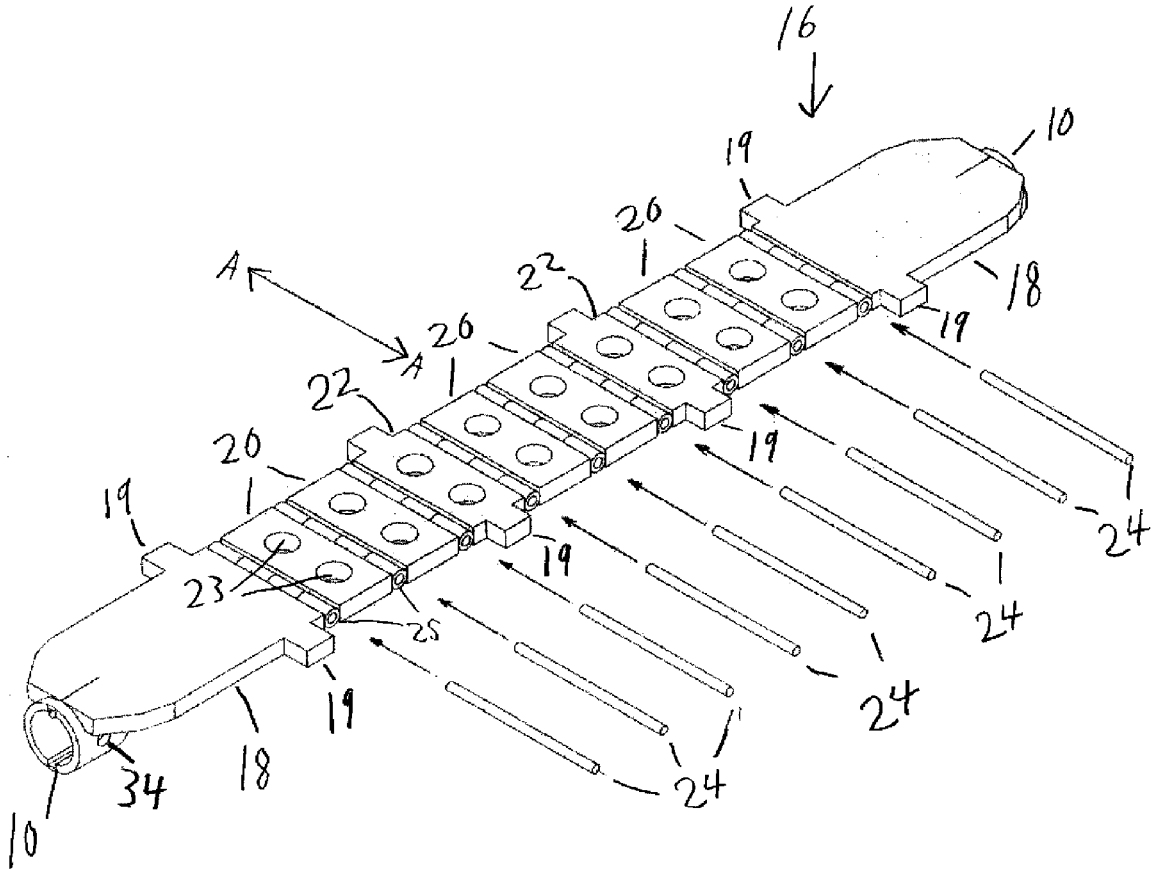
FIG. 9 is a perspective view of an assembled articulated insole construction with connectors at the heel and toe of the shoe.

Regarding FIG. 9, a detailed perspective view of an embodiment of an assembled articulated insole construction 16 is shown. The articulated insole construction 16 of FIG. 9 has an end plate 18 at each end. The end plates 18 are connected with one or more hinged plates 20, 22. In various embodiments of the invention, the insole construction 16 may be constructed with only hinged plates 20 lacking flanges 19, with only hinged plates 22 having flanges 19, or with various combinations of hinged plates 20, 22 with or without flanges 19. Further, the number of hinged plate 20, 22 may vary from that shown in FIG. 9, as more or fewer hinged plate 20, 22 may be needed depending on the size of the shoe being constructed.

In certain embodiments of the invention, the hinged plates and end plates are joined together with a hinge type connection. This connection may be made in a manner that allows for the free rotation of the plates relative to one another about axes transverse to the shoe, e.g. along axis A-A as shown in FIG. 9. In the embodiment of FIG. 9, the end plates 18 and hinged plates 20, 22 are connected with pins 24 that are inserted into pin holes 25. In certain embodiments of the invention, the pins 24 may be fastened within the pin holes 25 in a manner that prevents their removal. For example, the pins 24 may have special heads or caps that prevent them from being removed. Other mechanisms may also be used for connecting the end plates 18 and hinged plates 20, 22, such as brads or snaps.

Figure 10:
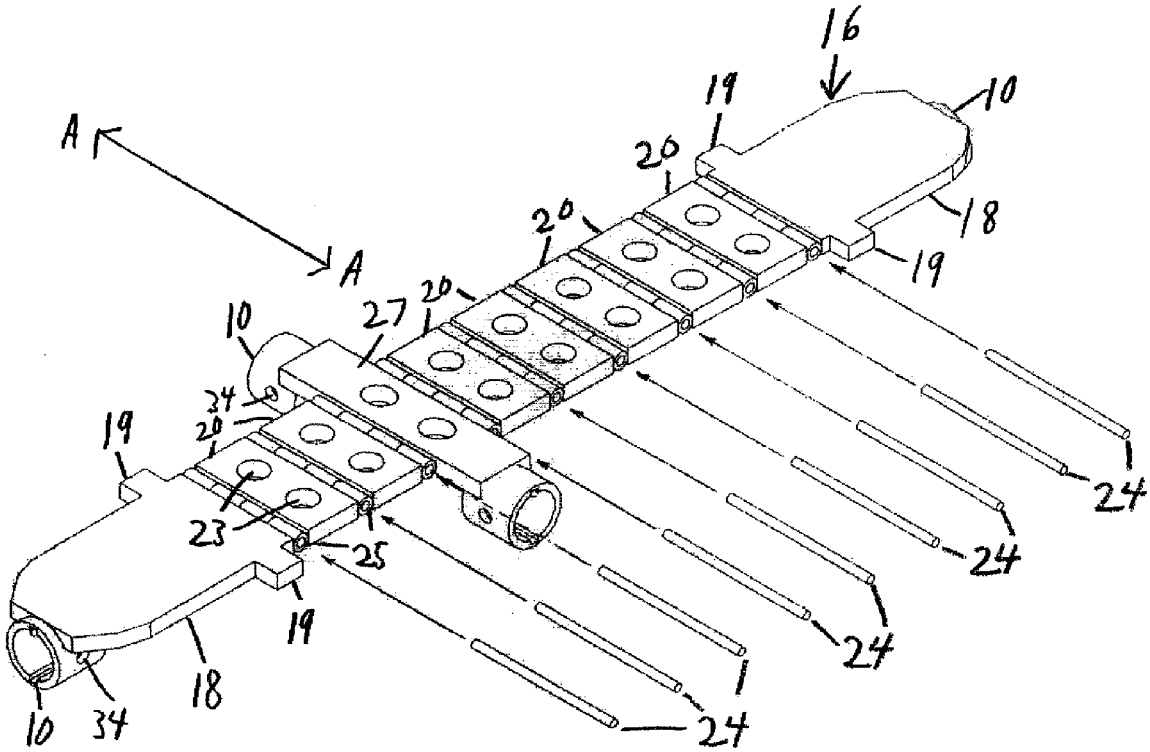
FIG. 10 is a perspective view of an assembled articulated insole construction with connectors at the heel, toe and sides of the shoe.

FIG. 10 shoes an embodiment of an articulated insole construction 16 of the present invention having a hinged plate 27 with a connector on each side. The embodiment of FIG. 10 may be assembled in the same manner as the embodiment of FIG. 9. In other embodiments of the present invention, the articulated insole construction 16 may be assembled so that the hinged plate 27 having a connector 10 is closer to the heel or toe of the shoe than is shown in FIG. 10. Further, in certain embodiments, the articulated insole construction 16 may be assembled with any combination and number of hinged plates 20, 22, 27.

The parts of the articulated insole construction 16 may be made of metal, plastic, wood, polymer, carbon fiber, rubber or other suitable material. All of the parts may be made from the same material, or they may be made of various materials within the same insole construction 16.

Figure 11:
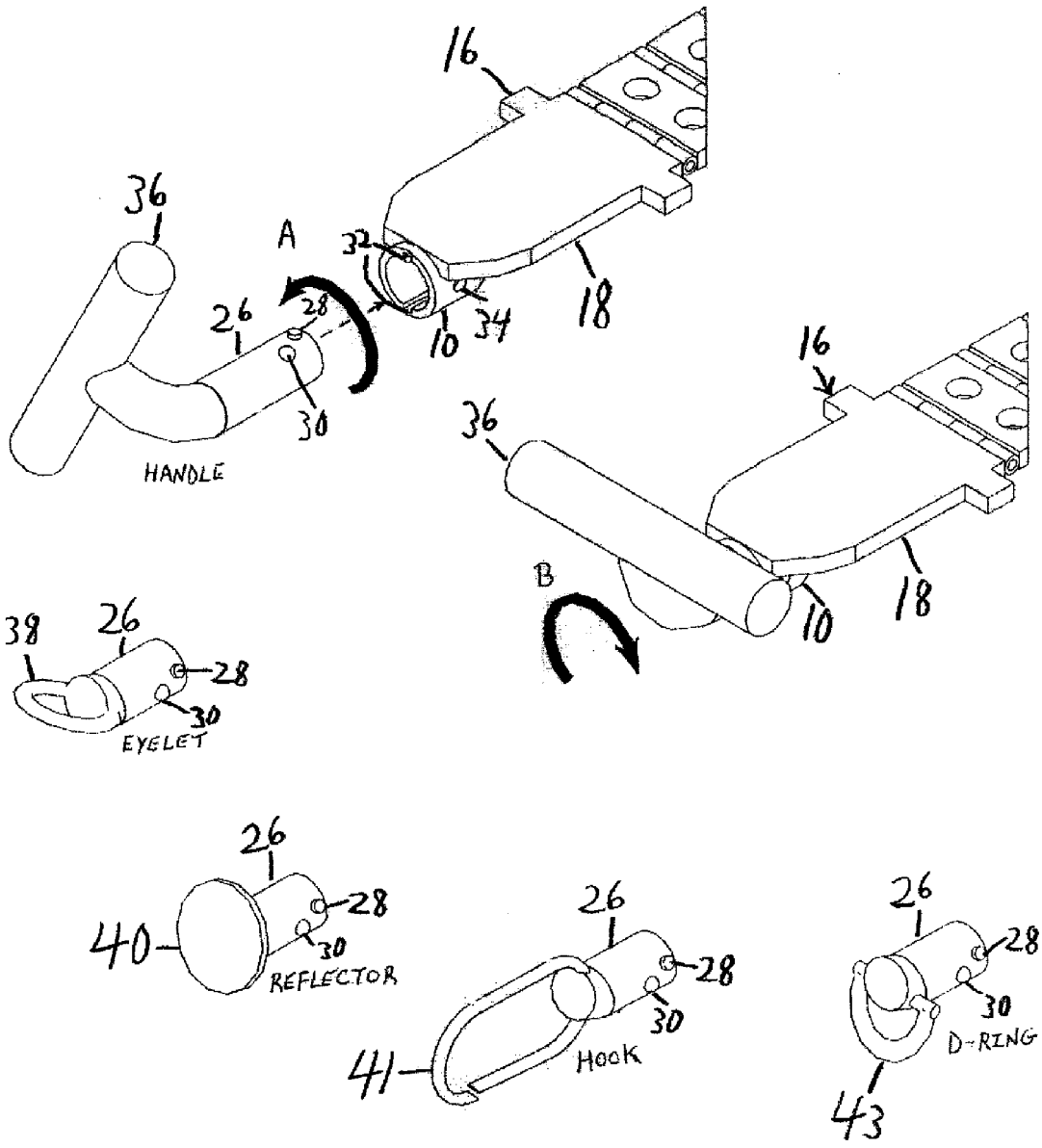
FIG. 11 is a close up perspective view of the connector of the end plate with various embodiments of attachments of the present invention.

FIG. 11 shows certain embodiments of devices that may be connected to the connector 10. Although FIG. 11 shows connection to a connector 10 on the toe of the shoe, the devices described may be connected to a connector 10 located anywhere on the shoe. The devices in general may have a shaft 26 that is received by the connector 10. The shaft 26 may have one or more mating guides 28 which align with mating grooves 32 in the connector 10 to allow for insertion and retention of the component. The shaft may also have one or more retractable members 30 that engage receiving holes 34 in the connector 10 to secure and correctly align the component to the shoe. The retractable member 30 may be supported by a spring or other mechanism capable of providing a compressible force, allowing it to be retracted while the shaft 26 is inserted into the connector 10. When the retractable member 30 aligns with the receiving hole 34, the retractable member 30 engages the receiving hole 34, causing the shaft 26 to be securely held within the connector 10. When the user of the shoe wishes to remove the component, the retractable member 30 is compressed so that it no longer engages the receiving hole 34 and the component is removed from the connector 10.

As shown in the embodiment shown in FIG. 11, a turning key mechanism may be used. In the embodiment of FIG. 11, the shaft 26 is turned in the direction of arrow A to so that the protruding member 28 aligns with an L- or T-shaped groove 32 inside of the connector 10. The shaft is then inserted into the connector. Once the protruding member is engaged with the full length of the groove, the component is turned in the direction of arrow B until the retracting member 30 engages the retaining hole 34, securely engaging the protruding member 28 within the L-shaped groove 32. To remove the attachment, the retracting member 34 is depressed while rotating the attachment in the opposite direction of arrow B.

It is also contemplated that other mechanisms can be used for attaching the components to the connector 10. In other embodiments, the attachment may snap into to connector and be held by a retaining mechanism. In still other embodiments of the present invention, a threaded screw mechanism may be used, e.g. the shaft 26 bears screw threads that align with threads inside the connector 10.

Certain embodiments of attachments of the present invention which may be attached to the shoe are shown in FIG. 11. These attachments include devices such as a handle 36, an eyelet 38, a reflector 40, a hook 41, and a D-ring 43 which may also have different sizes and shapes than those shown in FIG. 11. It is also contemplated that other attachments having devices that help facilitate strength training and fitness exercise may be attached. These include other devices such as loops, including loops made of material such as rope and the like, along with clips and spikes. The attachments may be made of a variety of materials, such as metal, plastic, wood, polymer, or carbon fiber and may be made of more than one material. The reflector attachment 40 may be made from various types of reflective materials, as are well known in the art. The attachments may be used for strength training and/or fitness exercise in various ways, such as those described below.

Figure 12A:
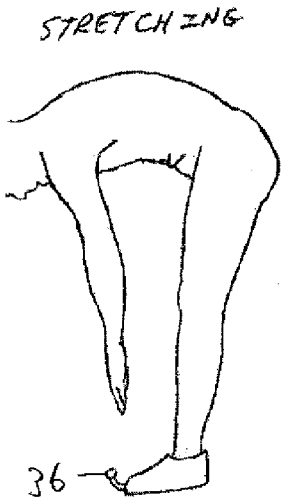
FIG. 12A is a schematic of a stretching exercise that can be done using a handle attachment with a shoe having an insole construction allowing for the attachment of exercise devices.

For example, as shown in FIG. 12A, a handle 36 may be attached to the toe of the shoe to facilitate stretching exercises. In the example of FIG. 12A, the wearer of the shoe reaches down towards his or her feet as in a standard "toe touch" stretch. Once the wearer is able to reach handle 36, the wearer may hold the handle, allowing him or her to remain in the "toe touch" position, facilitating stretching of the muscles of the lower body and back.

Figure 12B:
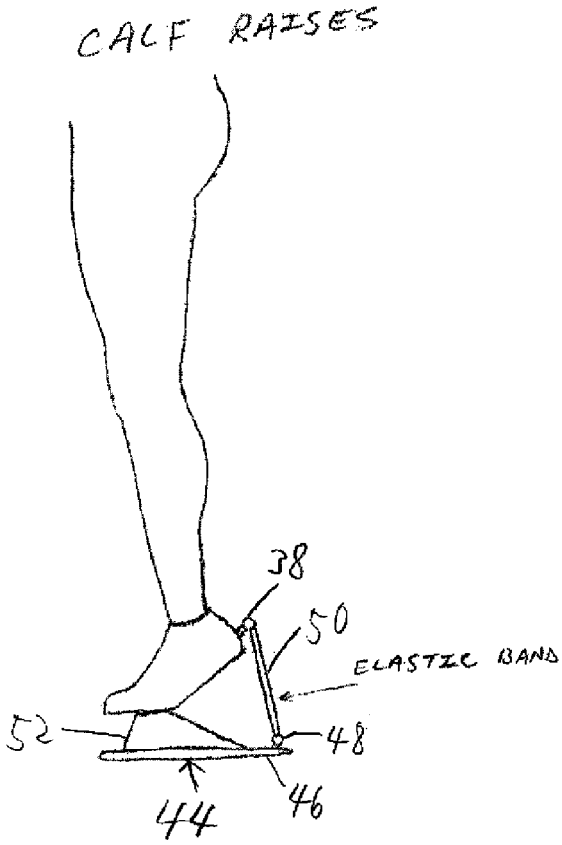
FIG. 12B is a schematic of a calf-raise apparatus and exercise using eyelet attachments and elastic bands with a shoe having an insole construction allowing for the attachment of exercise devices.

In FIG. 12B, a calf-raise device 44 for use with the present invention is shown. The calf-raise device 44 has a base 46 with one or more base eyelets 48. In the example shown in FIG. 12B, the wearer has an eyelet 38 attached to the heel of the shoe, to which an elastic band 50 can be attached. The other end of the elastic band 50 is attached to the base eyelet of the calf-raise device 44 and the wearer stands with the balls of his or her feet on top of a wedge 52 as shown. Once the wearer is in this position, he or she may move their heels up and down while the elastic bands provide resistance, causing the muscles of the lower body, back and stomach to be strengthened.

Figure 13A:
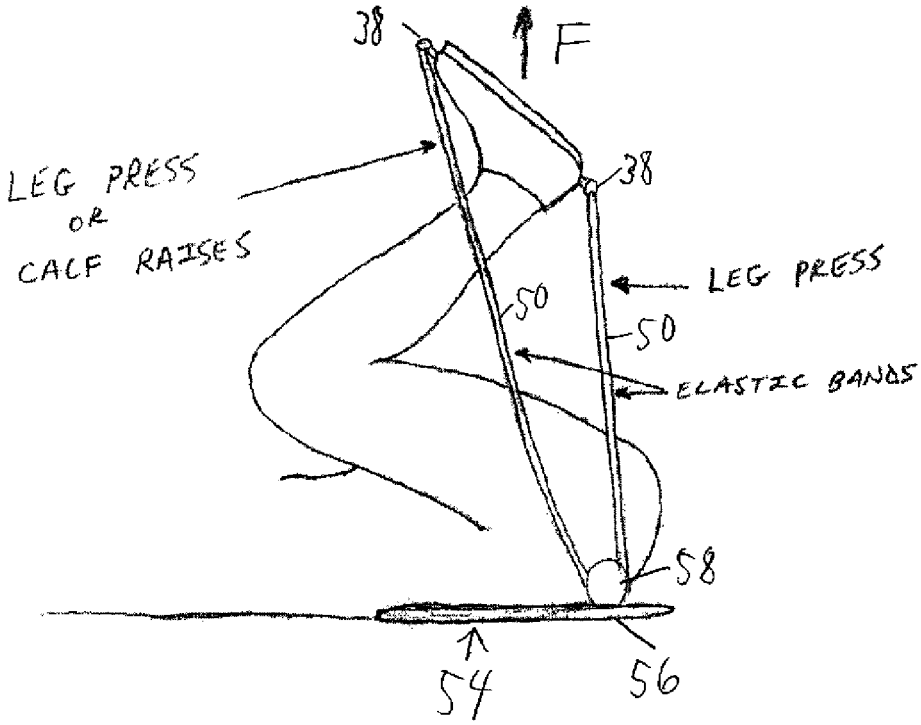
FIG. 13A is a schematic of one type of leg press exercise that can be done using a leg press apparatus and elastic bands with a shoe having an insole construction allowing for the attachment of exercise devices.
Figure 13B:
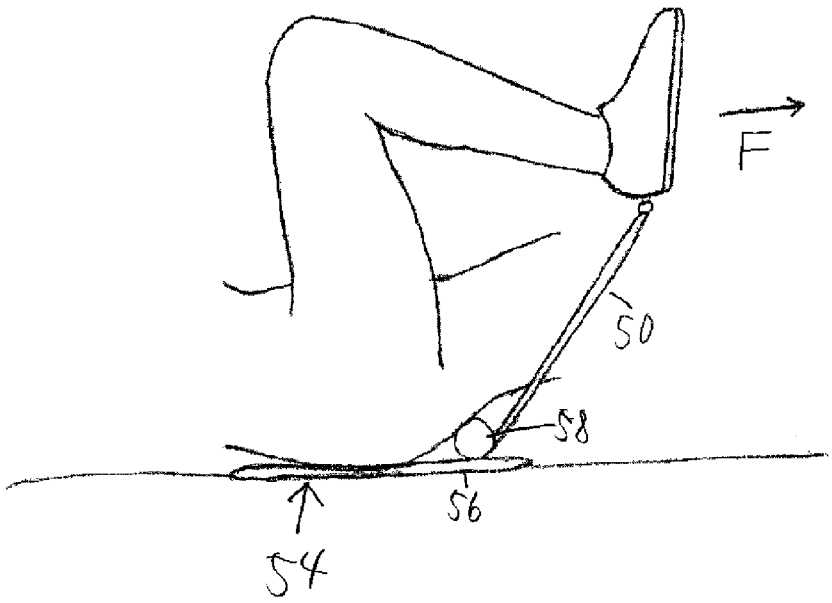
FIG. 13B is a schematic of a second type of leg press exercise that can be done using a leg press apparatus and elastic bands with a shoe having an insole construction allowing for the attachment of exercise devices.

FIGS. 13A and 13B show a leg press device 54 for use with the present invention. The leg press device has a base 56 with one or more base eyelets 58. In the example shown in FIG. 13A, the wearer lays on the base 56 and attaches two elastic bands 50 to the base eyelet 58. The other ends of the two elastic bands are then attached to eyelets 38 at the toe and heel of the shoe. The wearer may then move his foot in the direction of arrow F, while the elastic bands 50 provide resistance, causing the muscles of the legs to be strengthened. FIG. 13B shows a similar concept having only one elastic band 50 attached to an eyelet 38 at the heel of the shoe. The wearer then moves his or her foot in the direction of the arrow F, causing the muscles of the legs to be strengthened.

The elastic bands used with the invention may be made of rubber or other elastic material. Further the elastic bands may be replaced with other resistance bands, such as springs.

Figure 14:
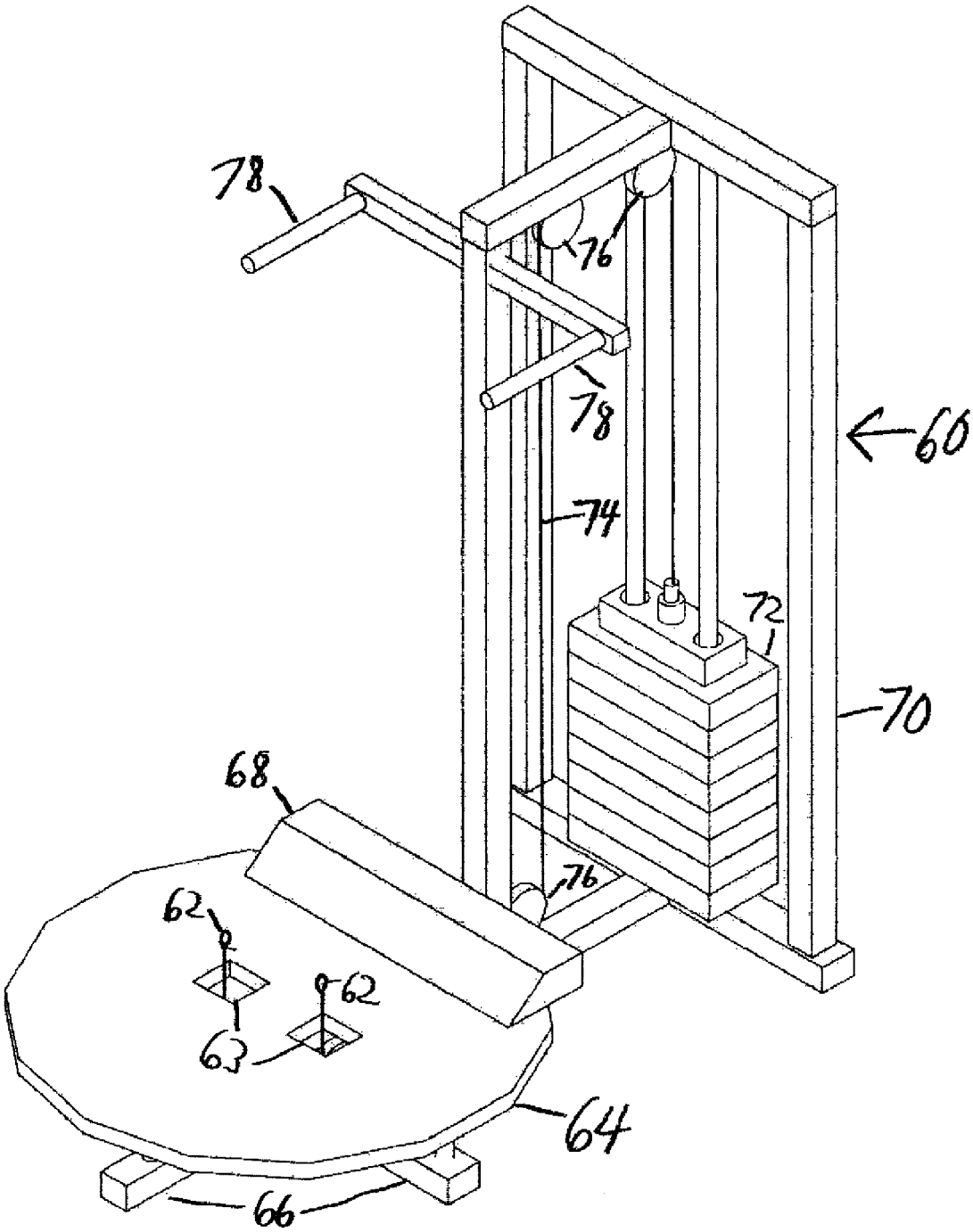
FIG. 14 is a perspective view of a leg strengthening apparatus with weight resistance that can be used with a shoe having an insole construction allowing for the attachment of exercise devices.

FIG. 14 shows a calf-raise device 60 for use with the present invention that uses weights for providing resistance. The calf-raise device shown in FIG. 10 has two attachment connectors 62 which protrude through openings 63 in a platform 64. Although the attachment connectors 62 shown in FIG. 14 are loops, the attachment connectors 62 may be replaced by hooks, or rings, such as a D-ring or other similar device to which an eyelet, other closed circle or hook structure can be easily attached and removed. The platform is raised off the ground by feet 66 which also stabilize the platform 64. On top of the platform is a wedge 68, on which the user of the device may stand, in a manner analogous to the calf-raise device shown in FIG. 12B. The platform is connected with a frame 70. A weight stack mechanism 72 within the frame 70 is operatively connected to the attachment connectors 62 through a weight cord 74, which runs through a system of pulleys 76 attached to the frame 70. The weight stack mechanism 72 has a series of weight plates, the resistance provided by which may be adjusted through placement of a pin or other member such is well known in the art.

The user of the device wears the shoe of the present invention having an eyelet or hook connected to the heel. The attachment of the shoe is then connected to the attachment connectors 62. The user of the device may place the balls of his feet on the wedge as previously described and may also hold on to optional handles 78 for further support. Once the user is positioned in this way, he or she may raise their heels against the resistance of the weight stack, causing the muscles of the lower body to be strengthened.

The reflector attachment 40 may be attached to the shoe of the present invention to make the shoe more visible in certain conditions. For example, the reflector attachment 40 may be used when running or bicycling along roads with vehicle traffic to increase the visibility of the wearer.

In other embodiments of the present invention, other types of elastic bands may be attached to the shoe. For example, one end of an elastic band may be attached to the shoe, while the other end of the elastic band has a handle for the user to hold. The user may then move their arms or legs in a manner that allows them to strengthen muscles in both the upper and lower body, including arms, legs and core musculature. Further, elastic bands attached to the shoe at one end may be attached to other attachment points at their other ends, including stationary points on a wall, floor or ceiling.

In other embodiments of the present invention, the shoes of the present invention may be used for safety purposes. For example, a climbing shoe may have attached devices that allow for the attachment of safety ropes or chains, or may have climbing spikes attached directly to the connectors of the shoe. Attachment of these types of safety devices may also be made in an embodiment of the present invention that is a work boot. For example, a person that works on a ladder or in a boom lift may wear boots according to the present invention that have attached devices which allow for the attachment of security lines that will prevent the wearer from falling.

The description of the present invention set forth herein, including the drawings, is meant to provide non-limiting description of the compositions and methods of the present invention. It should be apparent that there are variations of the present invention not explicitly presented in this specification that fall within the scope and the spirit of the invention as claimed.

What is claimed is:

1. A shoe comprising:

an articulated insole construction comprising an interior section, said interior section comprising:

a plurality of hinged plates extending from a toe to a heel of the shoe, the plurality of hinged plates being connected to each other by fastened hinges which are freely rotatable along an axis transverse to the shoe;

an end plate directly connected to one of the plurality of hinged plates; and, a connector directly connected to the end plate for receiving an attachment.

2. The shoe of claim 1, wherein the plurality of hinged plates and the end plate are hinged to one another so that they rotate along axes transverse to the shoe.

3. The shoe of claim 1, wherein the end plate is located so that an attachment may be received at the toe of the shoe.

4. The shoe of claim 1, wherein the end plate is located so that an attachment may be received at the heel of the shoe.

5. The shoe of claim 1, further comprising a second end plate having a connector for receiving an attachment.

6. The shoe of claim 1, wherein a hinged plate comprises a connector for receiving an attachment.

7. The shoe of claim 6, wherein the hinged plate comprising a connector is located so that an attachment may be received at the side of the shoe.

8. The shoe of claim 1, wherein the articulated insole construction further comprises a plurality of flanges embedded into the insole of the shoe.

9. The shoe of claim 1, wherein the articulated insole construction further comprises a plurality of holes formed therein.

10. The shoe of claim 1, wherein the hinged plates and the end plate are separately constructed from at least one material selected from the group consisting of:

metal, plastic, wood, polymer, carbon fiber and rubber.

11. The shoe of claim 1, further comprising an attachment comprising:

an exercise device; and a shaft capable of mating with the connector.

12. The shoe of claim 11, wherein the exercise device is a handle.

13. The shoe of claim 11, wherein the exercise device is an eyelet.

14. The shoe of claim 11, wherein the exercise device is a reflector.

15. The shoe of claim 11, wherein the exercise device is a hook.

16. The shoe of claim 11, wherein the exercise device is a D-ring.

17. The shoe of claim 11, wherein the exercise device is a loop.

18. The shoe of claim 11, wherein the exercise device is a spike.

19. The shoe of claim 11, wherein the exercise device is a clip.

20. The shoe of claim 11, wherein the connector is a tube and wherein the attachment shaft is a cylinder capable of mating with the connector tube.

21. The shoe of claim 11, wherein the attachment shaft comprises a protrusion on its surface, and wherein the connector comprises a mating groove for receiving the protrusion.

22. The shoe of claim 11, wherein the attachment shaft comprises a retaining member which protrudes from the shaft in a retractable manner; and wherein the connector comprises a receiving hole for receiving the retaining member.

23. An apparatus for strength training for use with a shoe having a connector for receiving an attachment having an exercise device, the apparatus comprising:

the shoe of claim 1;

a platform base having a first surface in contact with the ground and a second surface upon which a user of the apparatus stands; and an eyelet on the second surface for the attachment of elastic resistance components;

wherein one end of an elastic resistance component is attached to the eyelet of the apparatus and the other end is attached to the exercise device of the shoe.

24. An apparatus for strength training exercise the apparatus comprising:

the shoe of claim 1;

an attachment connector capable of being operatively connected to the exercise device of the attachment;

a weight source;

a frame supporting the weight source; and a cord operatively connecting the attachment connector with the weight source.

25. The shoe of claim 1, wherein the hinges are pin and barrel hinges.

26. The shoe of claim 1, wherein the attachment comprises a shaft having a first end and a second end, where the first end of the shaft is capable of mating with the connector and the second end of the shaft is attached to an exercise device.

27. The shoe of claim 1, wherein the connector is a female receptacle for receiving a male attachment.

28. The shoe of claim 1, wherein the connector is flush with the outside of the shoe.

29. The shoe of claim 1, further comprising:

an upper forming an upper outside of said shoe, wherein said articulated insole construction is directly connected to the upper at an interior of said shoe;

a midsole directly connected to a bottom of the insole construction; and an outsole directly connected to a bottom of the midsole and forming a lower outside of said shoe.

* * * * *